United States Patent [19]

Foster et al.

[11] Patent Number: 5,001,613

[45] Date of Patent: Mar. 19, 1991

[54] NEON TUBE LIGHTING SYSTEM, SUPPORT ASSEMBLY AND EXTRUSION THEREFOR

[76] Inventors: Ronald A. Foster, 1330 Deer Ridge, Duncanville, Tex. 75135; Ruben A. Reyes, 3527 Rio Grande Cir., Dallas, Tex. 75233

[21] Appl. No.: 550,614

[22] Filed: Jul. 10, 1990

[51] Int. Cl.[5] ..... F21S 3/00

[52] U.S. Cl. ..... 362/223; 362/260; 362/362

[58] Field of Search ..... 362/217, 222, 223, 263, 362/362, 260

[56] References Cited

U.S. PATENT DOCUMENTS

| | | | |
|---|---|---|---|
| 4,342,072 | 7/1982 | Guritz | 362/222 |
| 4,573,111 | 2/1986 | Herst et al. | 362/223 X |
| 4,667,275 | 5/1987 | Herst et al. | 362/223 |

*Primary Examiner*—Allen M. Ostrager
*Attorney, Agent, or Firm*—David H. Judson

[57] ABSTRACT

A neon tube lighting system, support apparatus and extrusion therefor is described for use in overcoming the problems associated with prior art free-standing neon tube lighting systems. The support assembly preferably comprises an extrusion, a reflector and an elongate lens member. The extrusion has first and second wall members located in substantially parallel aligned relation, and a bottom wall member interconnecting the first and second wall members and including a support, wherein the wall members form an enclosure having an opening therein between the first and second side wall members. Each of said first and second wall members of the extrusion includes an angular member extending into the enclosure towards the bottom wall member to form a bearing surface. The reflector has first and second angular wall members and a bottom wall member interconnecting the first and second angular wall members. According to the invention, each of the first and second angular wall members includes an edge cooperating with the respective bearing surface of the angular member when the reflector is secured to the support means to secure the reflector means in the enclosure. The elongate lens member is preferably V-shaped and is retained by the first and second wall members of the extrusion to close the openings. This construction insures that the neon tubing supporting in the enclosure is secure from weathering and other physical damage.

16 Claims, 3 Drawing Sheets

NEON TUBE LIGHTING SYSTEM, SUPPORT ASSEMBLY AND EXTRUSION THEREFOR

TECHNICAL FIELD

The present invention relates generally to lighting systems and particularly to a support assembly and extrusion therefor for use in supporting a neon tube.

BACKGROUND OF THE INVENTION

It is well-known to use neon tubing to provide decorative lighting effects for signage and building façades. Typically, the neon tubing is supported in a free-standing manner by merely embedding or affixing a tube support in the sign or facade. The neon tubing is then secured to or otherwise supported on the tube support. Such conventional border-neon installations are, of course, subject to extreme wear and degradation due to weathering and other environmental effects. The neon tubing can also be easily damaged since it is unprotected. These limitations severely limit the reliability of neon tube lighting systems and increase the cost thereof significantly.

It would therefore be desirable to provide improved neon tube lighting systems and support assemblies for overcoming these and other problems associated with the prior art.

BRIEF SUMMARY OF THE INvENTION

It is an object of the present invention to provide a neon-tube lighting system that protects the neon tubing from environmental and other physical damage.

It is yet another object of the invention to provide a cost-effective, safe and reliable neon tube lighting system for signage or a building façade.

It is still another object of the invention to describe a novel support assembly for supporting neon tubing.

It is another object of this invention to provide a novel structural extrusion for use in a support assembly of a neon lighting system which overcomes the problems associated with free-standing neon lighting systems of the prior art.

These and other objects of the invention are provided in an assembly for supporting a neon tubing comprising an extrusion, a reflector and an elongate impact-resistant lens member. The extrusion preferably has first and second wall members located in substantially parallel aligned relation, and a bottom wall member interconnecting the first and second wall members and including support means, wherein the wall members form an enclosure having an opening therein between the first and second side wall members. Each of said first and second wall members of the extrusion includes an angular member extending into the enclosure towards the bottom wall member to form a bearing surface. The reflector has first and second angular wall members and a bottom wall member interconnecting the first and second angular wall members. According to the invention, each of the first and second angular wall members includes an edge cooperating with the respective bearing surface of the angular member when the reflector is secured to the support means to secure the reflector means in the enclosure.

The extrusion preferably also includes first and second flanges projecting transversely from each wall member into the enclosure along substantially its entire length, the second flange located below the first flange and above the angular member. The first and second flanges cooperate to form a channel for receiving edges of the elongated lens member such that the lens member functions to close the opening of the enclosure. This construction insures that the neon tubing supporting in the enclosure is secure from weathering and other physical damage. Moreover, even if water were to enter the enclosure, the use of the angular member insures that a substantially water-tight seal is created between each such member and the angled wall member of the reflector.

The support means of the extrusion includes a track extending into the enclosure from the bottom wall member. The track includes a groove along substantially its entire length and ledge means, the groove for receiving fastener means for retaining the reflector against the ledge means. The bottom wall member of the extrusion also includes a flange projecting into the enclosure and including a first transverse section and a second angled section. The flange cooperates with the bottom wall member and one of the wall members to form a trough for electrical wires. Two or more extrusions can be supported in a side-by-side manner through the use of interconnecting pins supported in one or more bosses of the extrusion located where one of the wall members joins the bottom wall member. Similar bosses are preferably also integrally-formed between each angular member and the wall member.

In accordance with yet a further feature of the invention, an integral one-piece extrusion having the above-identified features is provided for use in a neon tube lighting system.

The foregoing has outlined some of the more pertinent objects of the present invention. These objects should be construed to be merely illustrative of some of the more prominent features and applications of the invention. Many other beneficial results can be attained by applying the disclosed invention in a different manner of modifying the invention as will be described. Accordingly, other objects and a fuller understanding of the invention may be had by referring to the following Detailed Description of the preferred embodiment.

BRIEF DESCRIPTION OF THE DRAWINGS

For a more complete understanding of the present invention and the advantages thereof, reference should be made to the following Detailed Description taken in connection with the accompanying drawings in which.

Similar reference characters refer to similar parts throughout the several views of the drawings.

DETAILED DESCRIPTION

Figure 1:
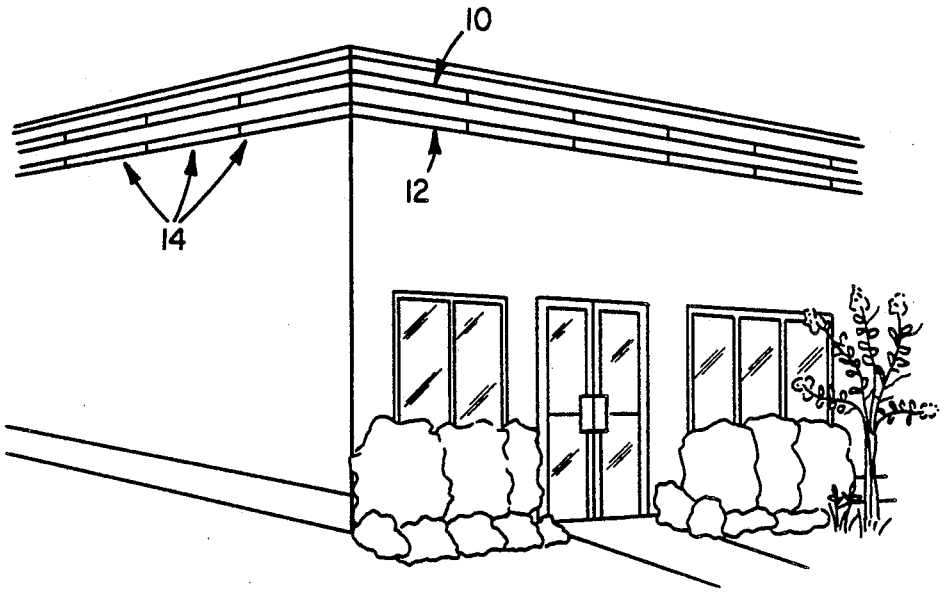
FIG. 1 is a perspective view of a conventional building facade having a neon tube lighting system incorporating the principles of the present invention.

Referring now to FIG. 1, a perspective view is shown of a neon tube lighting system incorporating the principles of the present invention. The system includes first and second continuous neon tube support subsystem 10 and 12 supported on the building facade. Each subsystem includes a plurality of support assemblies 14 secured in a side-by-side manner to support a continuous neon tubing for providing decorative lighting. Of course, although the teachings of invention are described in conjunction with neon lighting systems for a building façade, the principles of this invention are applicable to any neon tubing installation as well as in connection with other types of lighting (such as fluorescent and incandescent lighting).

Figure 2:
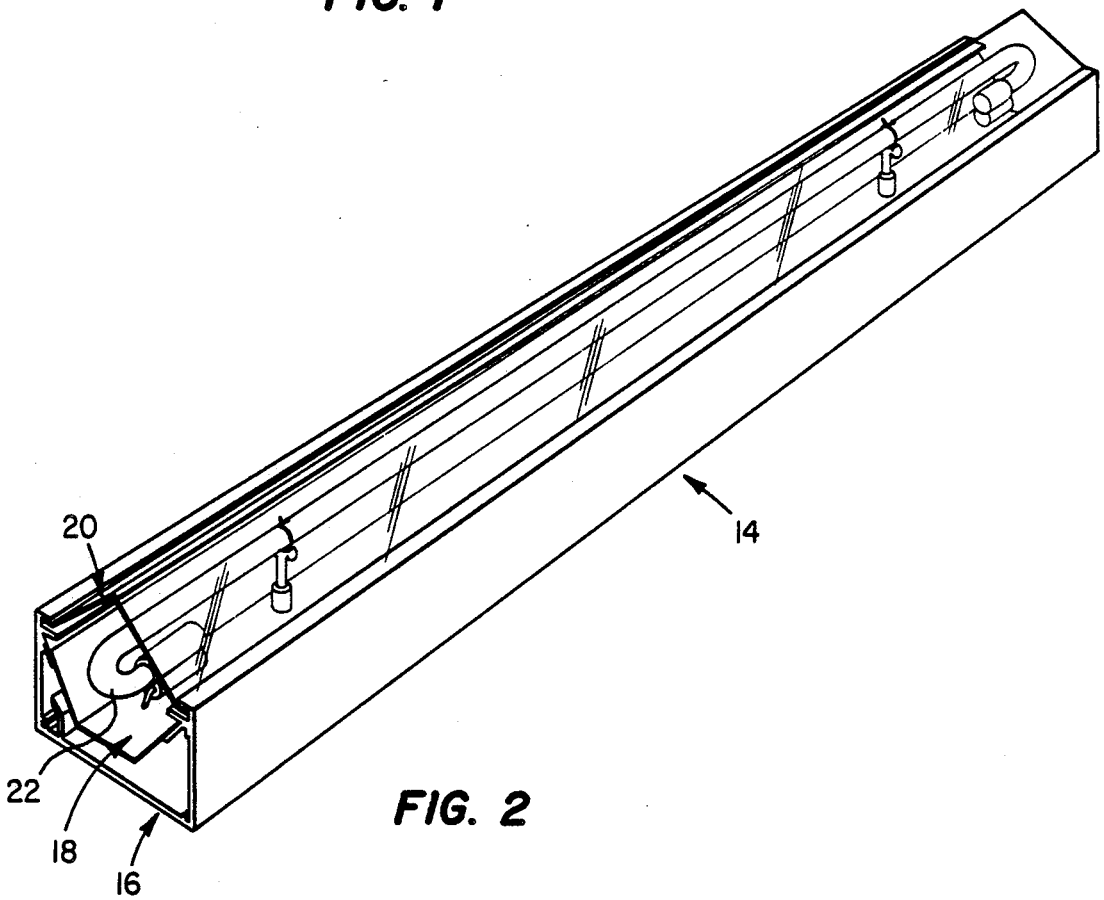
FIG. 2 is a schematic view of the neon tube support assembly of the present invention with the neon tubing supported therein.

FIG. 2 shows a perspective of a preferred construction of one of the neon tube support assemblies 14 of FIG. 1. Support assembly 14 comprises three basic elements: an extrusion 16, a reflector 18 and an elongated lens member 20. Although not meant to be limiting, the extrusion is preferably cast of aluminum or other lightweight material that can be painted to match any color of the building façade. The reflector 18 is likewise made of aluminum and includes a facing portion preferably painted white for maximum reflection. The lens member is preferably V-shaped and is formed of a clear, impact-resistant plastic material such as polycarbonate or similar material. Of course, the shape of the lens member alternatively can be semi-circular, flat, oval or hexagonal without departing from the nature and scope of this invention. The lens member serves to protect the neon tubing 22 from weathering or other physical damage as will be described in more detail below.

Figure 3:
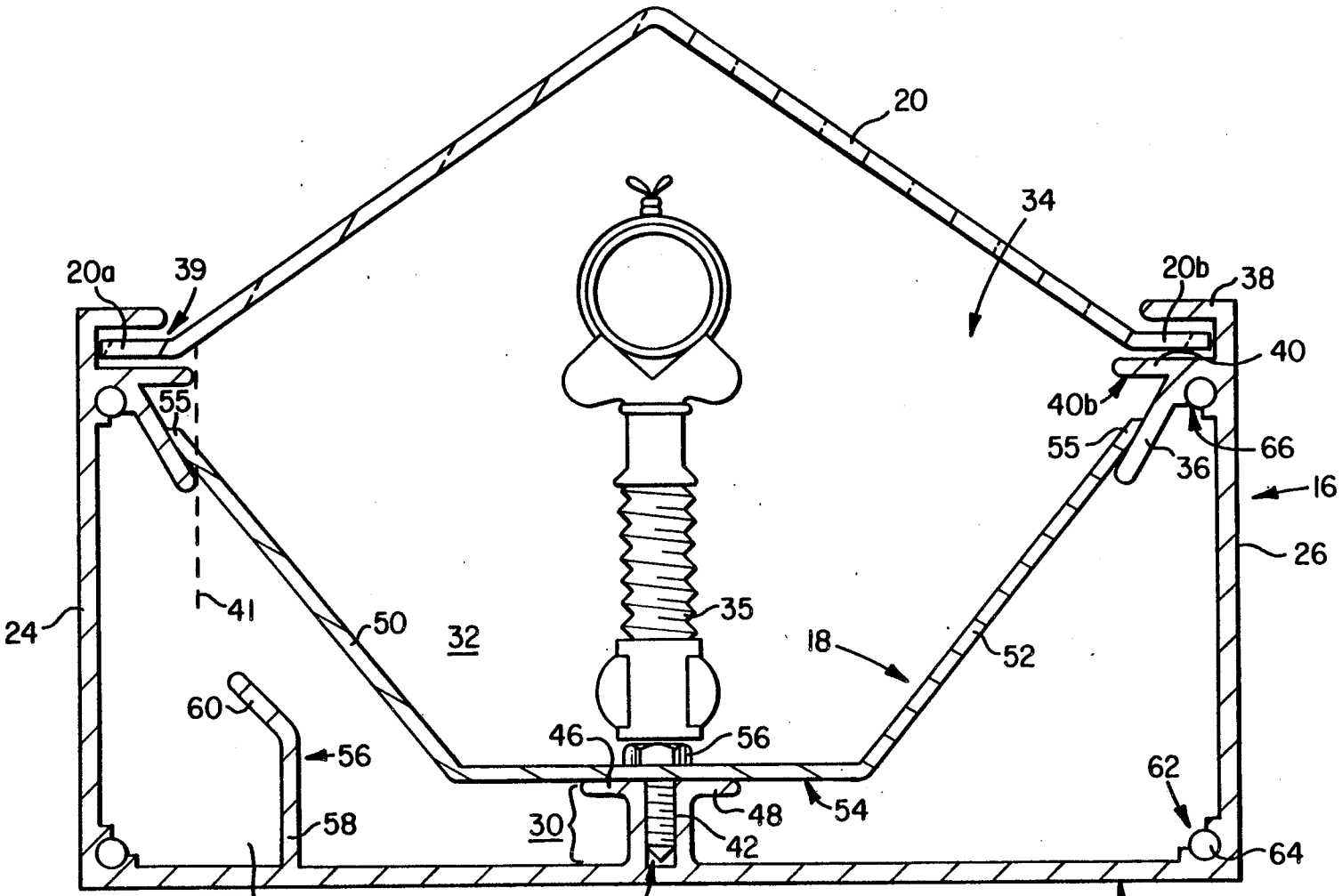
FIG. 3 is a detailed cross-sectional view of the neon tube support assembly of FIG. 2 showing the structure of the extrusion used therein.

With reference now to FIGS. 2 and 3, the extrusion 16 incorporates a unique construction for maintaining the neon tubing in a substantially weatherproof and physically-secure environment. In particular, extrusion 16 includes first and second wall members 24 and 26 located in substantially parallel aligned relation, and a bottom wall member 28 interconnecting the first and second wall members 24 and 26 and including support means 30. The wall members 24, 26 and 28 form an enclosure 32 having an opening 34 therein between the first and second side wall members 24 and 26. Each of the first and second wall members 24 and 26 includes an angular member 36 extending into the enclosure towards the bottom wall member 28 to form a bearing surface for portions of the reflector 18 as will be described. The angular members 36 Preferably extend along the entire length of each wall member. Each wall member of the extrusion further includes first and second flanges 38 and 40 projecting transversely from each wall member into the enclosure 32 along substantially its entire length, the second flange 40 located below the first flange 38 and above the angular member 36.

The first and second flanges 38 and 40 thus cooperate to form a channel 39 for receiving edges 20*a* and 20*b* of the elongate lens member 20. The lens 20 is thus designed to be snapped into and out of the extrusion 16 for enabling access to the enclosure 32. As will be described in more detail below, the second flange 40 extends into the enclosure slightly farther than the first flange 38 but to approximately the same lateral distance as the edge of the angular member 36. The edges of the second flange and the angular member thus are located in approximately the same plane 41. Preferably, the angle between angular member 36 and second flange 40 is approximately 60°.

Support means 30 of the extrusion 16 has a dual function and serves to support one or more neon tube supports 35 (shown in FIG. 2) as well as the reflector 18 itself. Referring back to FIG. 3, support means 30 comprises an integrally-formed track 42 extending into the enclosure 32 from the bottom wall member 28, the track 42 including a groove 44 along substantially its entire length and a pair of opposed ledges 46 and 48. As also best seen in FIG. 3, the reflector comprises first and second angular wall members 50 and 52 and a bottom wall member 54 interconnecting the first and second angular wall members 50 and 52. A suitable fastener, such as threaded screw 56, is then used to secure the bottom wall member 54 of the reflector 18 against the opposed ledges 46 and 46 of the support means 30.

According to a feature of the invention, each of the first and second angular wall members 50 and 52 of the reflector includes an upper edge 55 that cooperates with the bearing surface of the angular member 36 when the reflector is secured to the support means 30 to secure the reflector 18 in the enclosure 32. This construction provides several unique advantages. First, the upper edges 55 of the reflector 18 are tightly sealed (or spring-biased) against the bearing surfaces to substantially prevent dust or moisture from entering the area between the reflector and the rear of the extrusion. Since this is the area where electrical wiring is drawn through the assembly, this design provides a much safer construction. Moreover, because the edges of the second flange 40 and the angular member 36 are located in substantially the same plane 41, the reflector 18 is not easily removed from the extrusion when the fastener 56 is loosened and/or removed. In particular, due to flexibility of the reflector, the edges 55 thereof bear against the lower surfaces 40*b* of the second flanges 40 when the reflector is first snapped into the extrusion. The edges 55 also bear against the surfaces 40*b* when, following the securing of the reflector by fastener 56, the fastener 56 is subsequently loosened or removed. This construction provides an additional degree of safety because the reflector will not inadvertently lift upwards and damage the delicate neon tubing.

Referring back to FIG. 3, the bottom wall member 28 also includes a flange 56 projecting into the enclosure 32 and including a first transverse section 58 and a second angled section 60. The flange cooperates with the bottom wall member 28 and wall member 24 to form a trough 61 for electrical wires (not shown). As also seen, the extrusion 16 further includes one or more integrally-formed bosses 62, each of which are located where one of the wall members joins the bottom wall member 28. Each such boss preferably extends substantially the entire length of the assembly for receiving an interconnecting pin or keeper 64 for interconnecting the extrusion to another similar extrusion in a side-by-side manner. This operation facilitates the construction of the side-by-side support assemblies 14 of FIG. 1. If desired, extrusion 16 may also include similar bosses 66 between the angular member and the wall member for receiving interconnecting pins.

To install the neon lighting system, the extrusion 16 is installed directly against or in a flush (i.e., recessed) manner at the desired site of the accent lighting. If a continuous length of tubing is required, plural extrusions are mounted in a side-by-side manner as described above. After the wiring is installed, the reflector is secured in each extrusion and the neon tubing is installed. After testing, the lens is snapped into the extrusion to complete the installation.

Figure 4:
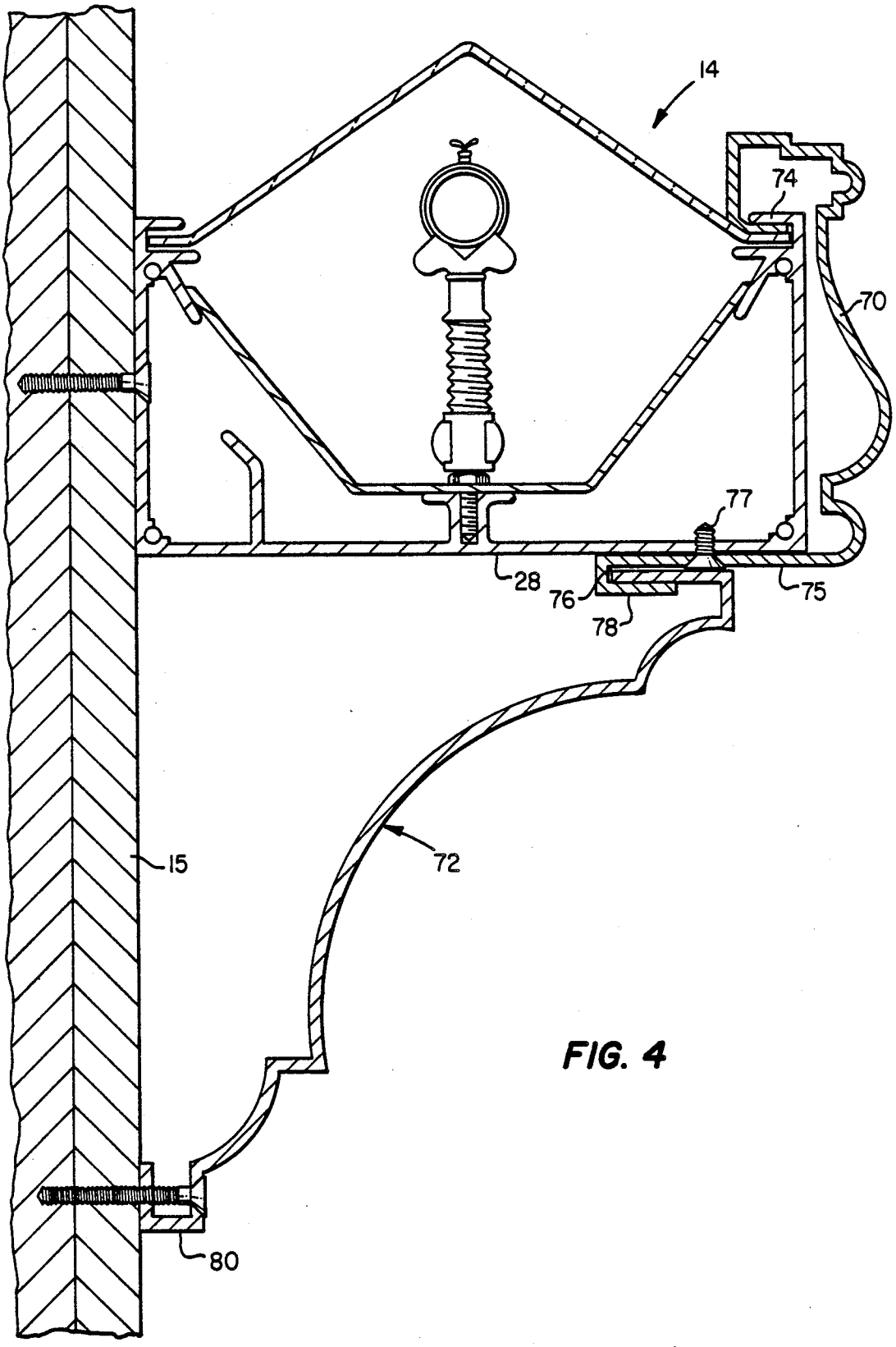
FIG. 4 is a side view of a preferred installation wherein a decorative trim package is affixed to the neon tube support assembly.

Referring briefly to FIG. 4, the support assembly 14 can be attached to a wall 15 and combined with a decorative trim package to provide an aesthetically-pleasing lighting system. Although not meant to be limiting, the trim package includes a first decorative member 70 and a second decorative member 72. The first decorative member 70 includes an upper flange 74 adapted to be fitted into one of the channels between the first and second flanges 38 and 40 to retain the member 70 against the support assembly. A base portion 75 of the member 70 is preferably fastened to the base member 28 of the extrusion by threaded fastener 77. The first decorative member 70 also includes a slot 76 adjacent the bottom edge thereof for receiving a flange 78 of the second decorative member 72. The bottom edge 80 of the member 72 is then secured to the wall 15 as shown. Preferably, the trim package is also formed of extruded, continuous lengths of aluminum.

It should be appreciated by those skilled in the art that the specific embodiments disclosed above may be readily utilized as a basis for modifying or designing other structures for carrying out the same purposes of the present invention. For example, the reflector can be omitted from the system in which case the angular members 36 can also be omitted. Alternatively, the reflector itself can be integrally formed as part of the extrusion by extending the angular member from each side wall member and joining the ends together to form a closed trough. Another alternative construction is provided if one of the wall members is removably secured to the bottom wall member. It should also be realized by those skilled in the art that such equivalent constructions do not depart from the spirit and scope of the invention as set forth in the appended claims.

What is claimed is:

1. An assembly for supporting a neon tubing, comprising:

an extrusion having first and second wall members located in substantially parallel aligned relation, and a bottom wall member interconnecting the first and second wall members and including support means, wherein the wall members form an enclosure having an opening therein between the first and second side wall members;

wherein each of said first and second wall members includes an angular member extending into the enclosure towards the bottom wall member to form a bearing surface;

a reflector having first and second angular wall members and a bottom wall member interconnecting the first and second angular wall members, wherein each of the first and second angular wall members includes an edge cooperating with the respective bearing surface of the angular member when the reflector is secured to the support means to secure the reflector in the enclosure; and an elongate lens member supported by the first and second side wall members over said opening.

2. The assembly as described in claim 1 wherein each of the first and second wall members of the extrusion include a first flange projecting transversely into the enclosure along substantially its entire length.

3. The assembly as described in claim 2 wherein each of the first and second wall members of the extrusion further include a second flange projecting transversely into the enclosure, the second flange located below the first flange and above the angular member and wherein the first and second flanges cooperate to from a channel for receiving edges of the elongate lens member.

4. The assembly as described in claim 3 wherein the lens member is substantially V-shaped and is formed of a clear plastic material.

5. The assembly as described in claim 1 wherein the support means of the extrusion comprises a track extending into the enclosure from the bottom wall member of the extrusion, the track including a groove along substantially its entire length and ledge means, the groove for receiving fastener means for retaining the bottom wall member of the reflector means against the ledge means.

6. The assembly as described in claim 3 wherein the support means further includes a tube support for the neon tubing.

7. The assembly as described in claim 1 wherein the bottom wall member of the extrusion also includes a flange projecting transversely into the enclosure and including a first transverse section and a second angled section, the flange cooperating with the bottom wall member and one of the wall members to form a trough for electrical wires.

8. The assembly as described in claim 1 wherein the extrusion further includes an integrally-formed boss where one of the wall members joins the bottom wall member for receiving means for interconnecting the extrusion to another similar extrusion in a side-by-side manner.

9. The assembly as described in claim 8 wherein the extrusion further includes an integrally-formed boss between the angular member and the wall member for receiving means for interconnecting the extrusion to another similar extrusion in a side-by-side manner.

10. An extrusion for use in a neon tube lighting system, comprising:

first and second wall members located in substantially parallel aligned relation, and a bottom wall member interconnecting the first and second wall members and including support means, wherein the wall members form an enclosure having an opening therein between the first and second side wall members;

an angular member extending from each wall member into the enclosure towards the bottom wall member to form a bearing surface for a reflector of the neon tube lighting system; and first and second flanges projecting transversely from each wall member into the enclosure along substantially its entire length, the second flange located below the first flange and above the angular member and wherein the first and second flanges cooperate to from a channel for receiving edges of an elongate lens member of the neon tube lighting system.

11. The extrusion as described in claim 10 wherein the support means comprises a track extending into the enclosure from the bottom wall member, the track including a groove along substantially its entire length and ledge means, the groove for receiving fastener means for retaining the reflector against the ledge means.

12. The extrusion as described in claim 10 wherein the bottom wall member also includes a flange projecting into the enclosure and including a first transverse section and a second angled section, the flange cooperating with the bottom wall member and one of the wall members to form a trough for electrical wires.

13. The extrusion as described in claim 10 further including an integrally-formed boss where one of the wall members joins the bottom wall member for receiving means for interconnecting the extrusion to another similar extrusion in a side-by-side manner.

14. The extrusion as described in claim 10 further including an integrally-formed boss between the angular member and the wall member for receiving means for interconnecting the extrusion to another similar extrusion in a side-by-side manner.

15. A lighting system, comprising:

a neon tubing;

an extrusion having first and second wall members located in substantially parallel aligned relation, and a bottom wall member interconnecting the first and second wall members and including support means, wherein the wall members form an enclosure having an opening therein between the first and second side wall members, each of said first and second wall members including an angular member extending into the enclosure towards the bottom wall member to form a bearing surface;

means for supporting the neon tubing in the support means of the extrusion;

a reflector having first and second angular wall members and a bottom wall member interconnecting the first and second angular wall members, wherein each of the first and second angular wall members includes an edge cooperating with the respective bearing surface of the angular member;

means for securing the reflector to the support means of the extrusion to secure the reflector in the enclosure; and an elongate lens member supported by the first and second side wall members over said opening.

16. The lighting system as described in claim 15 further including a decorative trim package secured to the extrusion.

* * * * *